US009906850B2

(12) United States Patent
Gleissner

(10) Patent No.: US 9,906,850 B2
(45) Date of Patent: Feb. 27, 2018

(54) HEADPHONE UNIT

(71) Applicant: Sennheiser electronic GmbH & Co. KG, Wedemark (DE)

(72) Inventor: Achim Gleissner, Barienrode/Diekholzen (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/306,177

(22) PCT Filed: Apr. 28, 2015

(86) PCT No.: PCT/EP2015/059176

§ 371 (c)(1),
(2) Date: Oct. 24, 2016

(87) PCT Pub. No.: WO2015/165890

PCT Pub. Date: Nov. 5, 2015

(65) Prior Publication Data

US 2017/0048601 A1 Feb. 16, 2017

(30) Foreign Application Priority Data

Apr. 28, 2014 (DE) ..... 10 2014 207 945

(51) Int. Cl.
*H04R 25/00* (2006.01)
*H04R 1/10* (2006.01)
(Continued)

(52) U.S. Cl.
CPC ..... *H04R 1/1008* (2013.01); *H04R 1/1041* (2013.01); *H04R 1/1075* (2013.01);
(Continued)

(58) Field of Classification Search
CPC ..... H04R 1/10; H04R 1/026; H04R 1/1041; H04R 5/02; H04R 5/033; H04R 5/0335
See application file for complete search history.

(56) References Cited

U.S. PATENT DOCUMENTS

| | | | |
|---|---|---|---|
| 7,388,960 | B2 | 6/2008 | Kuo et al. |
| 8,094,860 | B2 | 1/2012 | Haung |

(Continued)

FOREIGN PATENT DOCUMENTS

| | | |
|---|---|---|
| GB | 2 455 141 | 6/2009 |
| JP | 2000/316198 | 11/2000 |
| JP | 2010/074831 | 4/2010 |

OTHER PUBLICATIONS

International Search Report for Application No. PCT/EP2015/059176 dated Jul. 13, 2015.

*Primary Examiner* — Brian Ensey
(74) *Attorney, Agent, or Firm* — Haug Partners LLP

(57) ABSTRACT

A headphone having a first and a second ear pad each having a housing, a peripherally extending ear cushion, and a first electroacoustic reproduction transducer that emits sound outwardly, which is arranged in or on the housing of the ear pad. At least one second reproduction transducer emits sound toward a user's ear. In a first operating position, the ear pads are placed with the ear cushion on or around an ear. In a second operating position, the ear cushions of the first and second ear pads bear against each other so that provided therebetween is a closed volume that serves as a resonance chamber for the two first electroacoustic reproduction transducers when the two electroacoustic reproduction transducers are activated in the second operating position.

11 Claims, 3 Drawing Sheets

(51) Int. Cl.

| | |
|---|---|
| ***H04R 1/28*** | (2006.01) |
| ***H04R 3/14*** | (2006.01) |
| *H04R 1/32* | (2006.01) |

(52) U.S. Cl.

CPC ..... *H04R 1/2811* (2013.01); *H04R 3/14* (2013.01); *H04R 1/323* (2013.01); *H04R 2430/01* (2013.01)

(56) References Cited

U.S. PATENT DOCUMENTS

| | | | |
|---|---|---|---|
| 2006/0233388 | A1 | 10/2006 | Liow et al. |
| 2009/0041267 | A1 | 2/2009 | Lee et al. |
| 2011/0002478 | A1 | 1/2011 | Pollard et al. |
| 2013/0003984 | A1 | 1/2013 | Belafonte et al. |

HEADPHONE UNIT

The present application claims priority from International Patent Application No. PCT/EP2015/059176 filed on Apr. 28, 2015, which claims priority from German Patent Application No. 10 2014 207 945.4 filed on Apr. 28, 2014, the disclosures of which are incorporated herein by reference in their entirety.

FIELD OF THE INVENTION

It is noted that citation or identification of any document in this application is not an admission that such document is available as prior art to the present invention.

The present invention concerns a headphone.

Headphones are in particular of such a design configuration that a hoop band connects two ear pads or half-shells together in each of which there is a respective electroacoustic reproduction transducer. The headphone is then placed on a head in such a way that the ear pads or half-shells extend around or rest on the ears of the users. A useful signal in the form of an audio signal can then be reproduced by way of the two electroacoustic reproduction transducers. Headphones are typically of such a design or configuration that they are optimized for audio reproduction if the two ear pads or half-shells are placed on or over the ears of the user.

U.S. Pat. No. 7,388,960 B2 discloses a headphone having a headband and two ear pads, in each of which are provided headphone reproduction transducers and an audio reproduction transducer so that the user can listen to music both when the headphone is on his head and also when the headphone is not on his head.

In the German patent application from which priority is claimed the German Patent and Trade Mark Office searched the following documents: GB 2 455 141 A, U.S. Pat. No. 7,388,960 B2, U.S. Pat. No. 8,094,860 B2, US 2006/0233388 A1, US 2009/0041267 A1, US 2011/0002478 A1, US 2013/0003984 A1 and JP 2010-074 831 A.

SUMMARY OF THE INVENTION

An object of the present invention is to provide a headphone which makes it possible both to reproduce an audio signal when the headphone is placed on the head and also to deliver an audible audio signal of good quality when the headphone is not placed on the head.

Thus there is provided a headphone comprising a first and a second ear pad which each have a housing, a peripherally extending ear cushion and a first and a second electroacoustic reproduction transducer arranged in or on the housing of the ear pad. The headphone has a first operating position in which the ear pads are placed with the ear cushion on or around an ear and the second reproduction transducers which are directed inwardly are activated. The headphone has a second operating position in which the ear cushions of the first and second ear pads bear against each other so that formed therebetween is a closed volume which can serve as a resonance chamber for the two first electroacoustic reproduction transducers when the two first electroacoustic reproduction transducers which are directed outwardly are activated in the second operating position. Reproduction outwardly into the free field with good quality can be effected by the provision of the internal volume as a resonance chamber.

Optionally there can also be provided only one first and/or only second reproduction transducer.

According to an aspect of the present invention there is a hoop band between the first and second ear pads. The ear pads can thus be held.

According to a further aspect of the present invention there is provided a fixing unit for pressing the ear cushions of the first and second ear pads against each other in the second operating position. That can provide an effective internal closed volume as the resonance chamber.

The fixing unit can be in the form of a joint in the band, the joint pressing the first and second ear pads against each other in the second operating position.

The fixing unit can be adapted to produce a spring force which presses the two ear pads against each other with at least 5 N.

According to a further aspect of the present invention the fixing unit has at least one magnet in order to magnetically press the first and second ear pads against each other.

According to a further aspect of the present invention there is provided a respective second electroacoustic reproduction transducer in the ear pad in particular for reproduction of an audio signal in the first operating position. In that way it is possible to provide an electroacoustic reproduction transducer which is activated only when the headphone is in the first operating position. In that way the electroacoustic reproduction transducer can also be optimized and adapted to that situation.

According to a further aspect of the present invention there is provided an electronic unit for controlling the reproduction of an audio signal by way of the electroacoustic reproduction transducers in the first and second operating positions.

According to a further aspect of the present invention the electronic unit is adapted to output the audio signal in the second operating position at a higher level by way of the electroacoustic reproduction transducers.

According to a further aspect of the present invention the electronic unit is adapted to provide a non-linear amplification of the audio signal in the second operating position.

According to a further aspect of the present invention the electronic unit is adapted to mix an artificial harmonic spectrum with the audio signal to be reproduced when the headphone is in the second operating position.

Thus there is provided a headphone having two ear pads or half-shells which each have a peripherally extending ear cushion. Provided at the ear pads or half-shells is at least one electroacoustic reproduction transducer which is arranged in or on the housing of the ear pad or the half-shell and which emits outwardly, that is to say away from the ear cushion. The headphone has a first operating position in which the ear pads or half-shells can be placed on or around the ear and a second operating position in which the two ear pads or the half-shells are so placed that the respective ear cushions bear against each other and thus provide an enclosed volume which can represent a resonance chamber.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
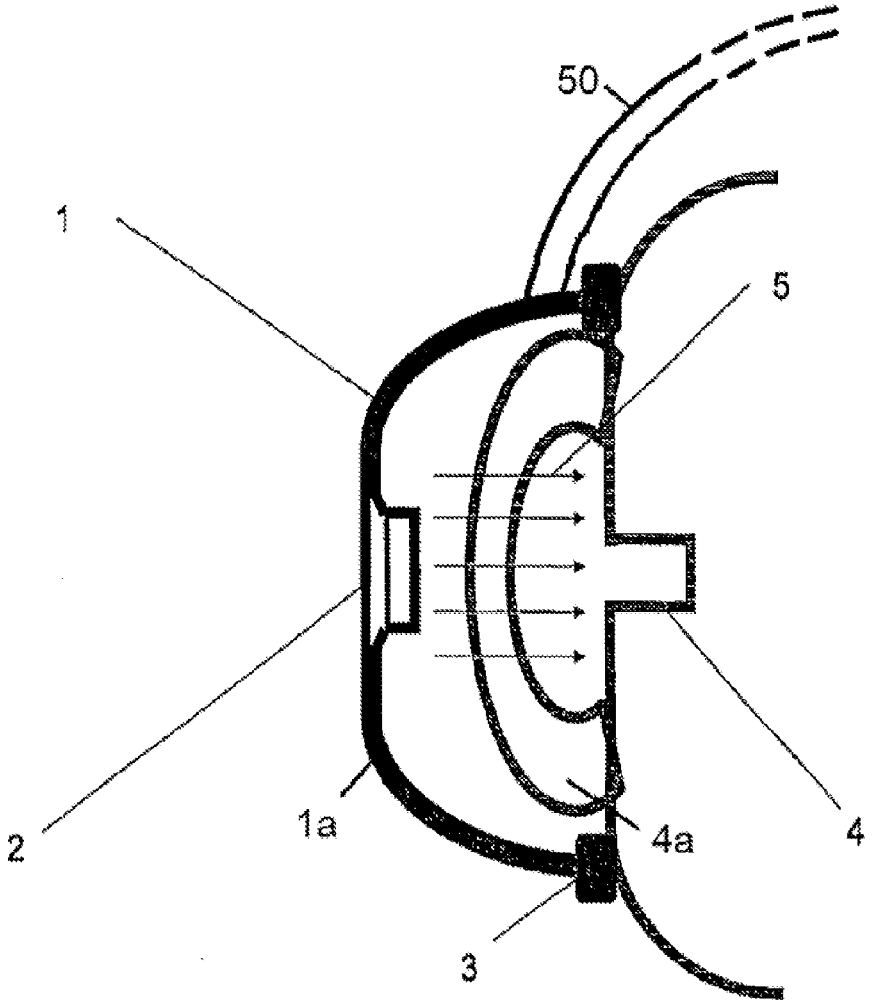
FIG. 1 shows a diagrammatic sectional view of a headphone according to a first embodiment.

FIG. 1 shows a diagrammatic sectional view of an ear pad of a headphone according to a first embodiment. The headphone has an ear pad or half-shell 1 with an ear cushion 3. The ear cushion 3 can be in the form of a peripherally extending ear cushion. An electroacoustic reproduction transducer 2 can be arranged in or on the housing 1*a* of the ear pad or the half-shell 1. A useful signal 5 can be emitted to an ear 4*a* of a user 4 by that electroacoustic reproduction transducer 5. The headphone according to the first embodiment is in the form of a circumaural headphone, that is to say the ear pad or the half-shell is so large that the ear cushion does not rest on the ear 4*a* of the user 4 but is arranged around the ear. As an alternative thereto the headphone can also be in the form of a supra-aural headphone. In that case the ear cushion 3 then rests against the ear 4*a* of a user 4.

Optionally the electroacoustic reproduction transducer 2 can be embedded in the housing of the ear pad 1 or the half-shell 1.

FIG. 1 shows in particular a first operating condition in which the headphone is used as an earphone or head-mounted headphone, that is to say the ear pad or the half-shell 1 is placed on or around the ear 4*a* of a user 4 so that the useful sound 5 from the electroacoustic reproduction transducer 2 is emitted into the ear 4*a* of the user 4.

Optionally the headphone can have a band 50, for example a head band or a neck band which is connected to the two ear pads 1 (at the left and at the right) and carries the ear pads.

Figure 2:
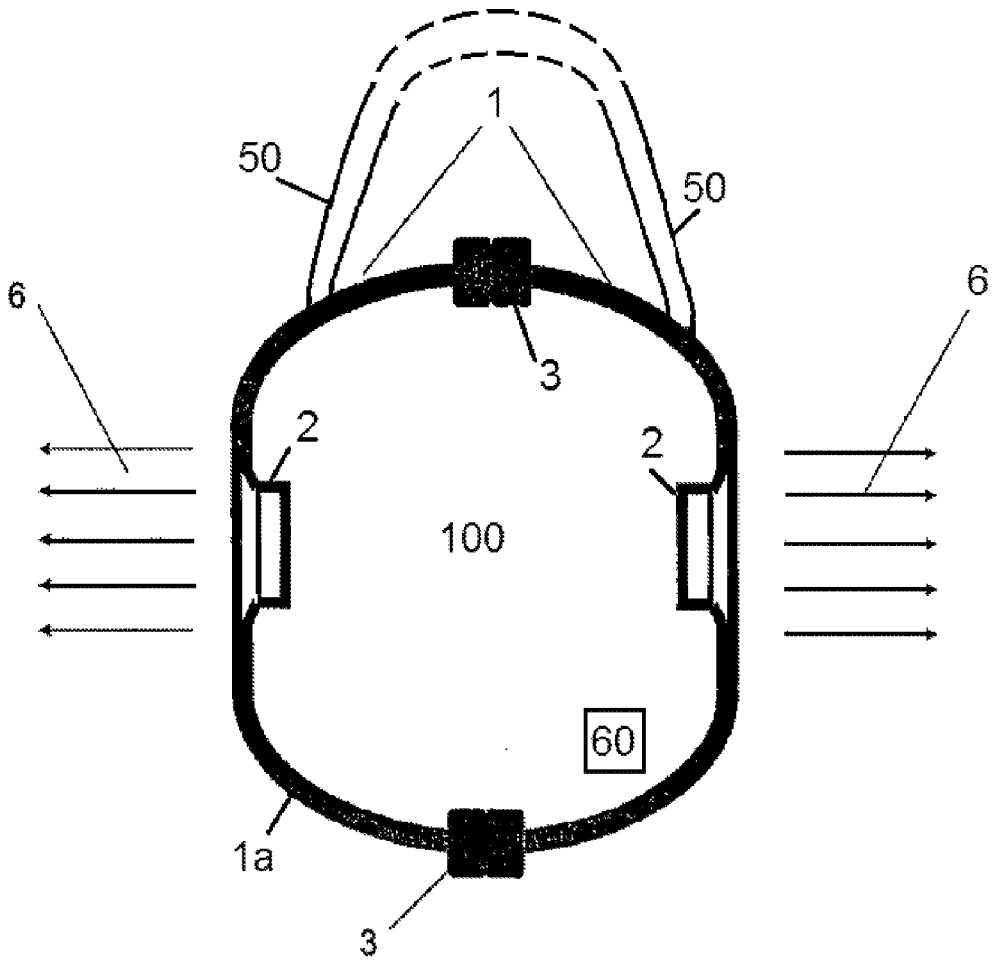
FIG. 2 shows a diagrammatic sectional view of a headphone according to the first embodiment.

FIG. 2 shows a diagrammatic sectional view of a headphone according to the first embodiment. FIG. 2 shows in particular the second operating position of the headphone. While FIG. 1 shows the first operating position in which the headphone rests against the ear or extends around the ear and the ear cushion 3 either rests against the ear 4*a* or encloses the ear the ear cushions 3 of the first and second half-shells 1 bear against each other in FIG. 2 so that a volume 100 is enclosed by the two ear pads or half-shells 1.

The reproduction transducers 2 are arranged on the housing 1*a* of the ear pad 1 and optionally emit the sound outwardly.

Preferably the seals or ear cushions 3 are in the form of peripherally extending ear cushions and in the second operating position respectively bear against each other over the full periphery so that a closed volume 100 is formed.

The closed volume 100 which is delimited by the two ear pads or half-shells 1 can be used as a loudspeaker housing or a resonance chamber so that the result in the second operating position is that the electroacoustic reproduction transducers 2 (that is to say the transducers which are arranged in or on the housing 1) emit an audio signal outwardly into the free field 6.

The design configuration of the two ear pads or half-shells 1 in the second operating position makes it possible to overcome a serious disadvantage of the design configuration of the ear pads or half-shells which are optimized for reproduction in the first operating position. That disadvantage is in particular that a large volume is required as a resonance chamber behind the electroacoustic reproduction transducer, for delivery of sound into the free field. Such a large resonance volume as a resonance chamber however cannot be implemented in the case of a head-mounted headphone as this would have an adverse effect on size and wearing comfort. The small volumes behind the electroacoustic reproduction transducer, which are typically only present in the headphones or earphones, allow only inadequate depth reproduction. In addition, it is not possible to provide an adequate level above all in the low-frequency spectrum for free field transmission of a headphone.

According to the invention the volume 100 which is closed in the second operating position can be used as a loudspeaker housing or as a resonance chamber in free field reproduction. The closed acoustic volume 100 is also advantageous because that prevents an acoustic short-circuit. It should further be noted that the resonance frequency is predetermined by the volume of the housing and by additional acoustic filters. A uniform sound pressure level is possible above the resonance frequency while the sound pressure level drops greatly below the resonance frequency.

Optionally the headphone can have a band 50, for example a head band or a neck band, which is connected to the two ear pads 1 (at the left and at the right) and carries the ear pads.

Optionally an electronic unit 60 can be provided in the headphone, which controls operation of the reproduction transducers 2 and the audio output by way of the reproduction transducers 2.

Figure 3:
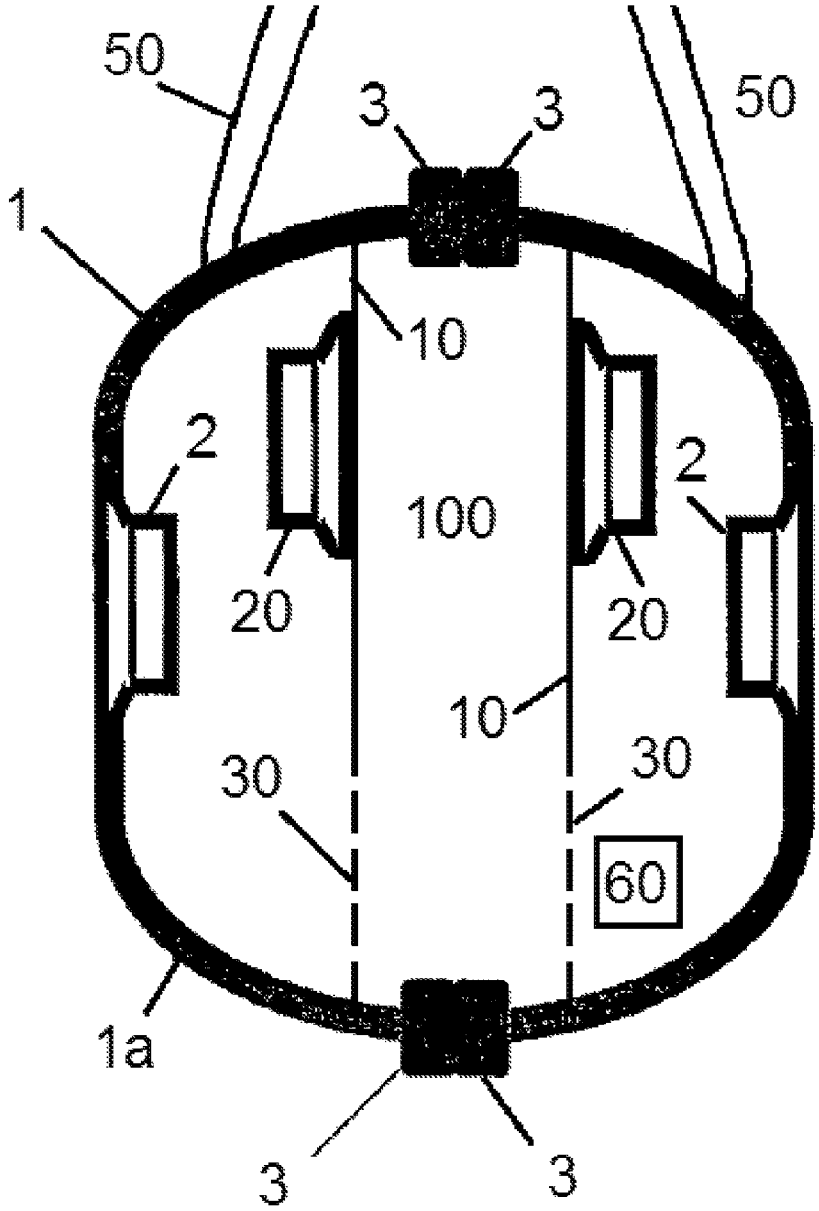
FIG. 3 shows a diagrammatic sectional view of a headphone according to a second embodiment.

FIG. 3 shows a diagrammatic sectional view of a headphone according to a second embodiment. The headphone according to the second embodiment is based on the headphone according to the first embodiment and in addition to the first reproduction transducer 2 has at least one second electroacoustic reproduction transducer 20 and optionally a by-pass 30. The second electroacoustic reproduction transducer 20 can optionally be provided at a wall 10 in the interior of the ear pad 1 and can emit sound inwardly or in the direction of the ear cushion 3. As in the first embodiment the headphone has two ear pads or half-shells 1 each having a peripherally extending ear cushion 3 and the first electroacoustic reproduction transducer 2 which is arranged in or on the housing of the ear pad or the half-shell 1 and which optionally emits sound outwardly, away from the ear cushions 3 or into the free field 6. In the second embodiment the first electroacoustic reproduction transducer 2 is provided for the reproduction of sound into the free field 6 and the second electroacoustic reproduction transducer 20 is provided for the reproduction of sound in the direction 5 of the ear of the user. Optionally a by-pass 30 can be provided for example through the wall 10.

According to the invention the second electroacoustic reproduction transducers 20 can be activated in the first operating position and the first electroacoustic reproduction transducers 2 can be activated in the second operating position.

According to the invention there can optionally be provided a fixing unit which holds the two ear pads or half-shells or their corresponding ear cushions 3 together in the second operating position.

It is possible to ensure in that way that the volume 100 remains closed. An infinite acoustic baffle can be achieved by the housings of the two ear pads 1 which are pressed against each other.

Optionally the two ear pads can be connected together by a band 50. That band 50 can optionally be in the form of a head band. Optionally the band can have a joint, by means of which the two ear pads or half-shells 1 are pressed against each other in order thereby to constitute a fixing unit. Optionally the pressure with which the two ear pads or half-shells 1 are pressed against each other can be at least 5 N.

Optionally a magnetic attraction can be provided between the two ear pads or half-shells 1 in the second operating position.

According to a further embodiment of the invention there can be provided a headphone which is based on the first and/or second embodiment and has an electronic assembly 60 which can switch over between a first operating mode (reproduction by way of the second reproduction transducer 20 inwardly) in the first operating position and a second operating mode (reproduction by way of the first reproduction transducers outwardly) in the second operating position. The first operating mode is optimized to operation of the headphone when the ear pads or half-shells are positioned on or around the ears (reproduction inwardly). The second operating mode is optimized to the audio signal being emitted into the free field 6 (reproduction outwardly). In that way in particular in the second operating mode the level of the reproduced audio signals can be higher than in the first operating mode.

Optionally the subjective hearing impression can be improved by a non-linear amplification produced by the electronic unit, in particular in the second operating mode.

Optionally the subjective hearing impression can be improved by adding an artificial harmonic spectrum produced by the electronic unit in the second operating mode.

According to the invention the headphone has two ear pads with a housing 1*a* and a peripherally extending ear cushion 3. Arranged in or on the housing 1*a* is a respective first electroacoustic reproduction transducer 2 which emits sound outwardly or into the free field 6. Thus the first reproduction transducer emits sound in a direction away from the ear cushion. The second reproduction transducer 20 is arranged within the housing 1*a* of the ear pad 1 and emits sound towards the ear of the user, that is to say inwardly or in the direction of the ear cushions.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A headphone comprising:

a first ear pad and a second ear pad, each of the first and second ear pads having:

a housing; and a peripherally extending ear cushion;

at least one first electroacoustic reproduction transducer that is arranged in or on the housing of one of the first and second ear pads to emit sound outwardly or away from the respective ear cushion; and at least one second reproduction transducer that is arranged within the housing of one of the first and second ear pads to emit sound inwardly or in the direction of the respective ear cushion;

wherein the headphone has:

a first operating position in which the ear pads are placed with each ear cushion on or around an ear; and a second operating position in which the ear cushions of the first and second ear pads bear against each other over their full periphery so that formed therebetween is a closed continuous volume serving as a continuous resonance chamber for the at least one first electroacoustic reproduction transducer when the at least one first electroacoustic reproduction transducer is activated in the second operating position.

2. The headphone as set forth in claim 1, further comprising:

a band between the first and second ear pads.

3. The headphone as set forth in claim 1, further comprising:

a fixing unit configured to press the ear cushions of the first and second ear pads against each other in the second operating position.

4. The headphone as set forth in claim 3;

wherein the fixing unit is in the form of a joint, in the band, that presses the first and second ear pads against each other in the second operating position.

5. The headphone as set forth in claim 3;

wherein the fixing unit is adapted to produce a spring force that presses the two ear pads against each other with at least 5 N.

6. The headphone as set forth in claim 4;

wherein the fixing unit has at least one magnet that magnetically presses the first and second ear pads against each other when the headphone is in the second operating position.

7. The headphone as set forth in claim 1, further comprising:

another second electroacoustic reproduction transducer that is arranged within the housing of the other of the first and second ear pads.

8. The headphone as set forth in claim 1, further comprising:

an electronic unit that controls reproduction of an audio signal by way of the first and second electroacoustic reproduction transducers in the first and second operating positions.

9. The headphone as set forth in claim 8;

wherein the electronic unit is adapted to output the audio signal in the second operating position at a higher level by way of the first and second electroacoustic reproduction transducers than in the first operating position.

10. The headphone as set forth in claim 8;

wherein the electronic unit is adapted to provide a non-linear amplification of the audio signal in the second operating position.

11. The headphone as set forth in claim 8;

wherein the electronic unit is adapted to mix an artificial harmonic spectrum with the audio signal to be reproduced.

* * * * *